US005447455A

United States Patent [19]

Plösser

[11] Patent Number: 5,447,455

[45] Date of Patent: Sep. 5, 1995

[54] CONTACT FOR TERMINATION OF COIL WINDINGS

[75] Inventor: Hartmuth G. F. Plösser, Lautertal, Germany

[73] Assignee: The Whitaker Corporation, Wilmington, Del.

[21] Appl. No.: 4,388

[22] Filed: Jan. 14, 1993

[30] Foreign Application Priority Data

Feb. 4, 1992 [GB] United Kingdom ..... 9202312

[51] Int. Cl.[6] ..... H01R 4/50

[52] U.S. Cl. ..... 439/863

[58] Field of Search ..... 439/863, 864, 400, 417, 439/441, 656, 853

[56] References Cited

U.S. PATENT DOCUMENTS

| | | | |
|---|---|---|---|
| 3,380,013 | 4/1968 | Krone et al. | 439/400 X |
| 3,391,375 | 7/1968 | Richards | 439/863 |
| 3,397,380 | 8/1968 | Puig | 439/656 X |
| 4,026,013 | 5/1977 | Hughes | 339/95 R |
| 4,166,265 | 8/1979 | Reynolds et al. | 336/192 |
| 4,251,911 | 2/1981 | Reynolds et al. | 29/605 |
| 4,699,444 | 10/1994 | Isohata | 439/839 |

FOREIGN PATENT DOCUMENTS

| | | |
|---|---|---|
| 3703020 | 8/1988 | Germany . |
| 2101968 | 1/1983 | United Kingdom . |

*Primary Examiner*—Eugene F. Desmond
*Attorney, Agent, or Firm*—Eric Groen; Adrian J. LaRue

[57] ABSTRACT

An electrical assembly for terminating magnet wire and the like has a housing with contact receiving cavities provided therein. The contact receiving cavities have separate support members which are positioned adjacent to respective side walls of the contact receiving cavities. The support members cooperate with the wires and the contacts to provide an effective and reliable electrical connection between the wires and the contacts.

18 Claims, 4 Drawing Sheets

CONTACT FOR TERMINATION OF COIL WINDINGS

BACKGROUND OF THE INVENTION

1. Field of the Invention

The invention is directed to a contact for use in terminating fine wire with varnish-type insulation. In particular, the invention is directed to a contact which is reliable in various environments.

2. Brief Description of the Prior Art

It is known in the industry to use contact terminals to terminate coils. The contact terminals do not require soldering but rather penetrate the insulation of the coil wire and establish electrical contact with the core thereof. U.S. Pat. Nos. 4,026,013 and 3,979,615 show two types of contact terminals which are being used in the electrical industry for establishing contact with electrical coils. In accordance with the principles of these prior art patents, cavities are provided in the coil support which are dimensioned to receive the terminals and the coil wire is located in these cavities during the winding process. After the winding process has been completed, it is merely necessary to insert terminals into the cavities to establish contact with the ends of the wire. The above identified patents do not required separate terminal posts on the bobbin.

It is also known in the industry to provide a bobbin which has wire binding posts extending therefrom as part of the bobbin molding, as shown in U.S. Pat. No. 4,166,265. The coil bobbin has terminal receiving cavities in one of its flanges which are located such that the operations of wrapping the coil wire around the first binding post, passing the coil wire through one of the cavities, winding the required number of turns on the coil supporting surface, passing the wire through the second cavity and finally wrapping the wire around the remaining post, can be carried out by a coil winding machine. After these operations have been carried out, terminals can be inserted into the cavities and the binding posts can be cut from the bobbin. Cutting of the binding post also results in cutting the coil wire adjacent to the fixed ends of the binding posts. The completed bobbin thus contains terminals in its terminal receiving cavities which are connected to the coil wire and which can be connected to the external conductors when the coil is placed in a circuit.

Although the termination described in U.S. Pat. No. 4,166,265 provides for a reliable electrical connection is certain instances, in other instances the electrical connection may fail as the coil wire is not adequately retained in position relative to the contact terminal. The coil wire is trapped between the housing and the contact terminal inserted therein. As the connector is exposed to various environments, the housing and terminals are caused to expand or contract. As the housing and terminals are made from different materials, the rate of expansion and contraction will vary between the materials. Consequently, in various environments the housing will be moved away from the terminal, allowing the coil wire to move relative to the contact terminal. The result is the loss of the electrical connection between the terminal and the wire, as the coil wire is moved out of electrical contact with the contact terminal. This is an unacceptable result.

SUMMARY OF THE INVENTION

The invention is directed to a contact terminal for use in terminating coil wire or the like. The contact terminal positions the coil wire between two metallic members when the coil wire is terminated, thereby ensuring that a positive electrical connection will be effected in all types of environments.

DETAILED DESCRIPTION OF THE INVENTION

Figure 1:
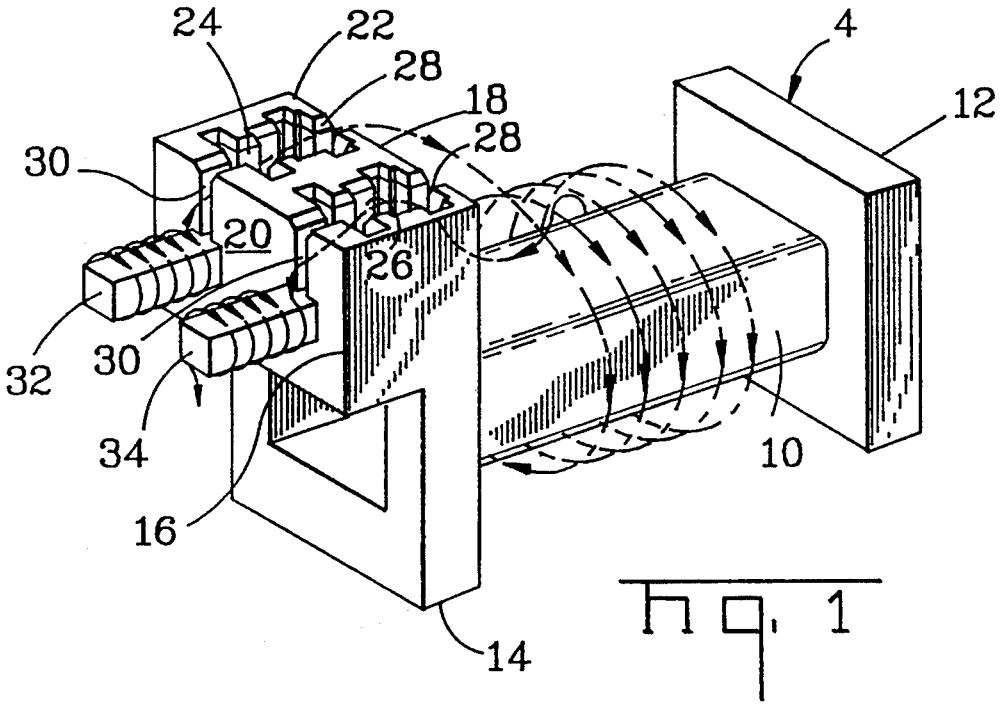
FIG. 1 is a perspective view of one form of coil bobbin in which a contact is provided in a reinforced cavity.
Figure 2:
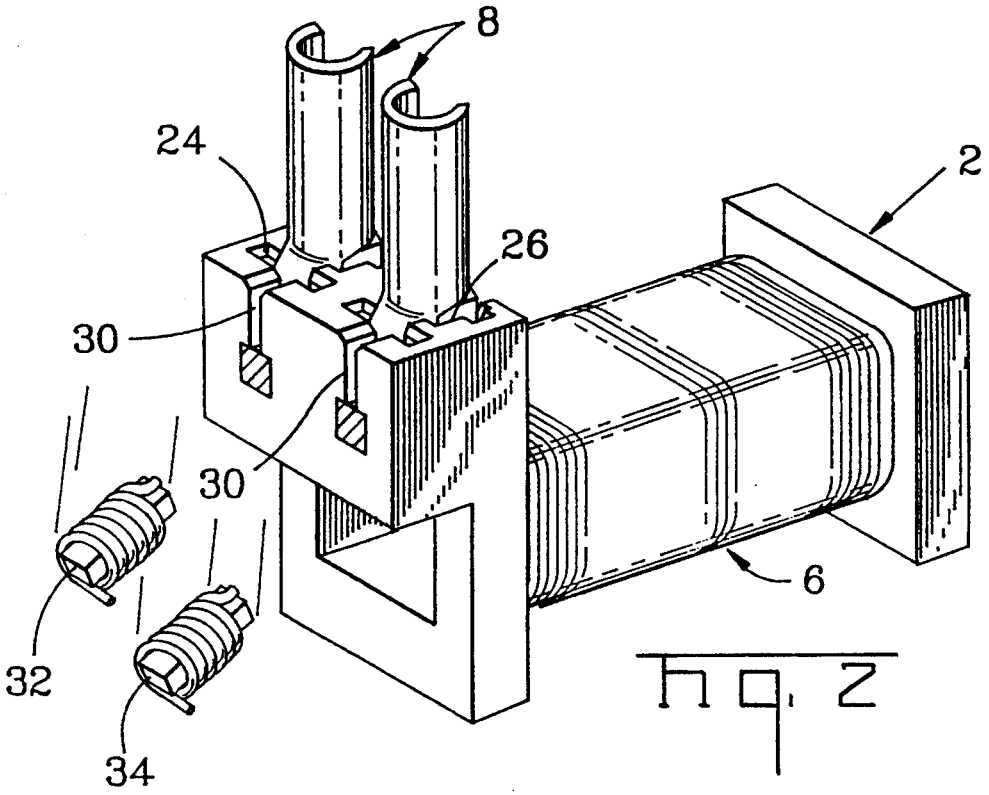
FIG. 2 is a perspective view of a completed coil winding.
Figure 3:
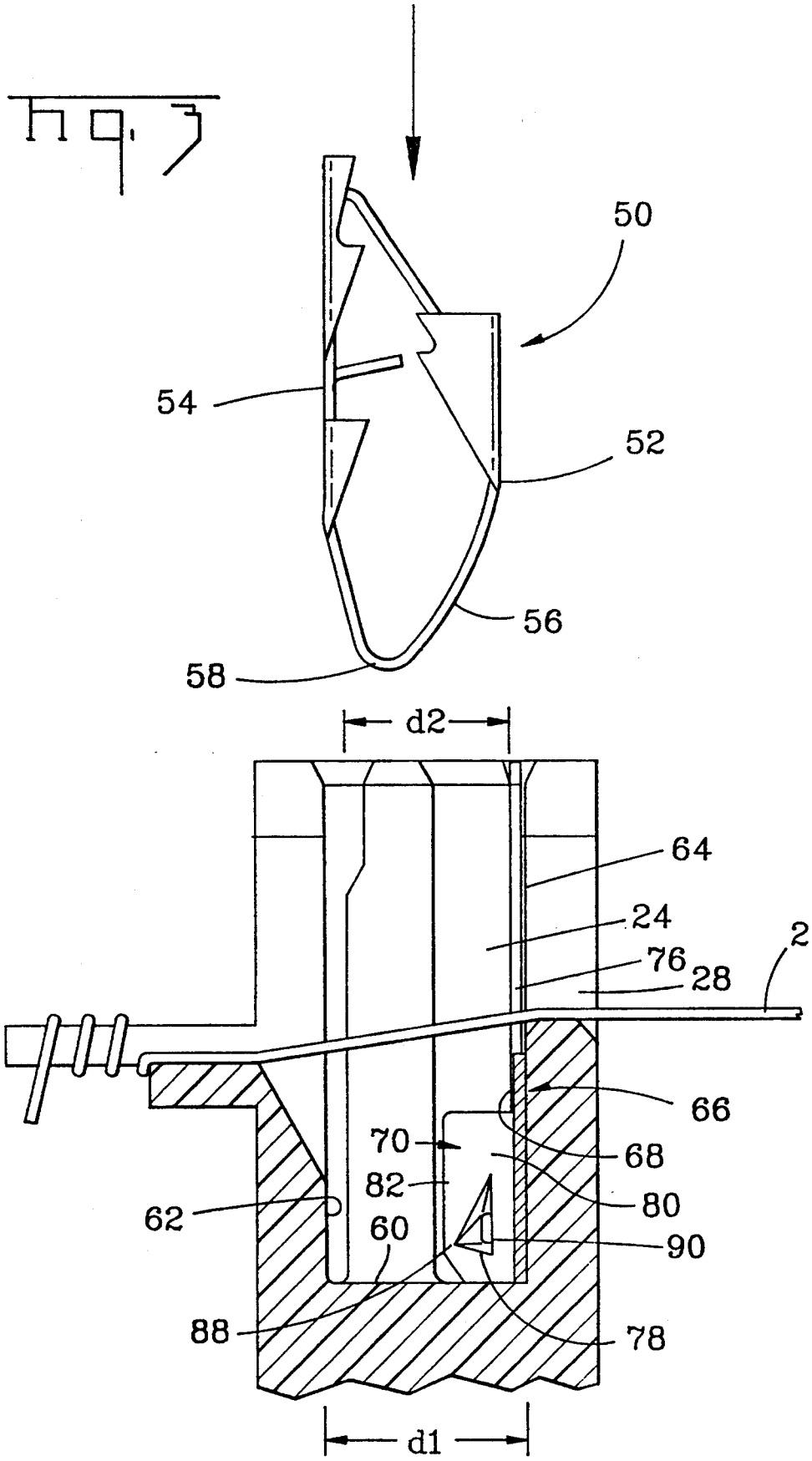
FIG. 3 is a cross-sectional view of the contact prior to insertion into the reinforced cavity of the coil housing.

Referring first to FIG. 1, an electrical coil 2 has a bobbin 4 having flanges 12, 14 at each end of its coil supporting surface 10. The flange 14 has an enlarged upper portion 16, this enlarged portion having a first surface 18 which is adjacent to coil supporting surface 10, a second surface 20 which is parallel to, and spaced from, surface 18 and a third upwardly facing surface 22 which extends between the first and second surfaces. Two terminal receiving cavities 24, 26 extend inwardly from the surface 22 and slots 28, 30 are provided on the opposed sidewalls of each cavity which are proximate to the surfaces 18, 20. These slots are dimensioned to accommodate portions of the coil wire so that the wire can be located in crossing relationship to the cavities, as shown in FIG. 3. Binding posts 32, 34 extend from the surface 20 adjacent to the lower ends of the slots 30 of each cavity.

Bobbins of the type shown in FIG. 1 are usually manufactured by injection molding of a suitable thermoplastic material such as glass filled nylon material. Advantageously, the material should be such that the binding posts can be severed from the flange 14 during a manufacturing process as is more fully discussed in U.S. Pat. No. 4,166,265.

In the manufacture of the completed coil assembly 2 the coil wire is first wrapped around the post 32 and then passed through the slot 30, through the cavity 24, and through the slot 28 of the cavity 24. The required number of turns are then wound on the coil supporting surface 10 and after the coil has been wound, the wire is passed through the slot 28 of the cavity 26, across the cavity 26, through the slot 30 and is then wound on the binding post 34.

The electrical connections to the ends of the winding wire are made by inserting terminals 8 into each of the terminal receiving cavities 24, 26.

Figure 4:
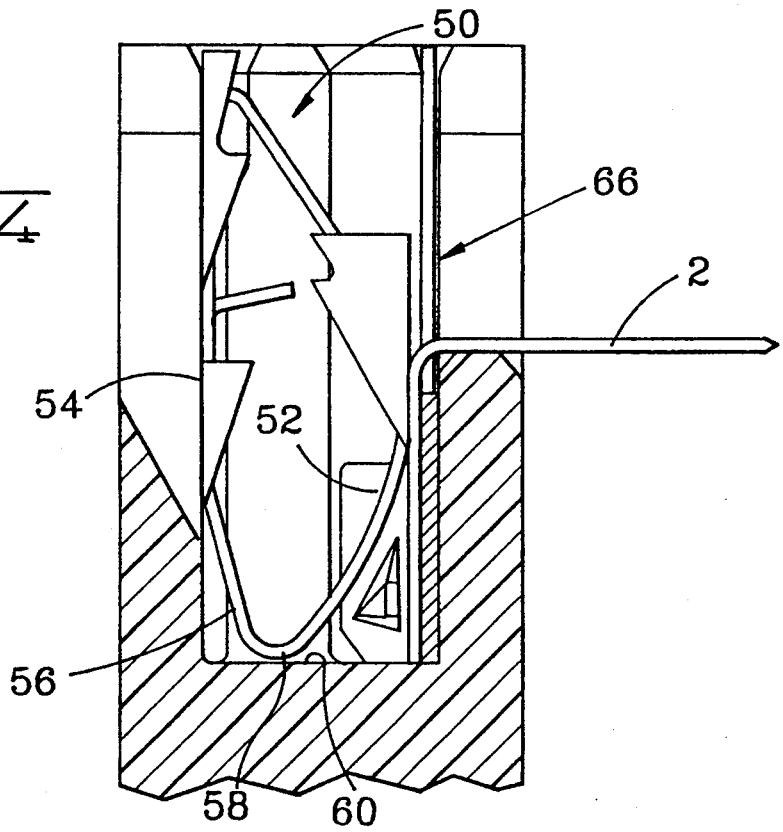
FIG. 4 is a cross-sectional view, similar to that of FIG. 3, of the contact partially inserted into the reinforced cavity.
Figure 5:
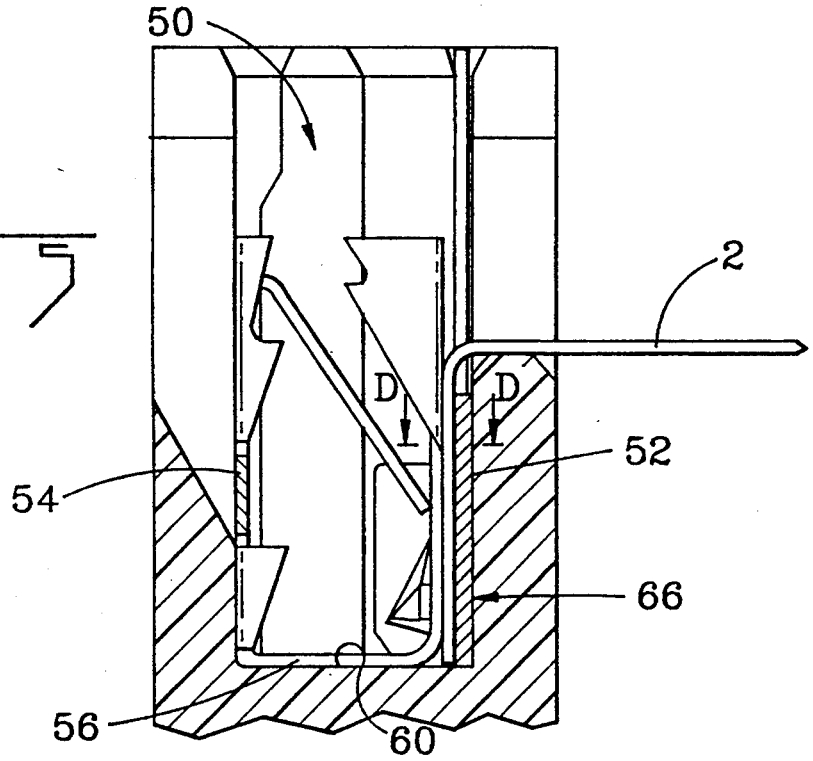
FIG. 5 is a cross-sectional view, similar to that of FIG. 3, of the contact fully inserted into the reinforced cavity.

Referring to FIGS. 3 through 5, each contact 50 has a first element 52, a second element 54, and a third element 56. It is to be noted that third element 56 forms an acute angle with the first element 52 and an obtuse angle with the second element 54. Thus, as the contact is inserted into a respective cavity 24 in the direction of the arrow of FIG. 3, the nose portion 58, will abut against the end wall of the cavity 24, thus restraining the nose portion 58 from further entry into the cavity 24. However, the second element 54 can and will travel into the slots and even after the nose portion has been stopped by the end wall 60. As cavities 24 and 26 are essentially identical, for ease of explanation and understanding, only cavity 24 will be used in the description. However, the cooperation of the contact with cavity 26 is identical.

As the second element 54 is inserted further into the cavity 24 the nose portion 58 will be forced further into the cavity 24 so that nose portion will eventually be forced flush against the end wall 60 as shown in FIG. 5.

It is noted that the distance between the inner surfaces 62,64 of sidewalls of the cavity 24 is designated as $d_1$. The distance $d_1$ is greater than the distance $d_2$ measured from the top of the nose portion 58. Consequently, it is only after the nose portion 58 strikes the end wall 60, and the third element 56 of the contact continues to move forward thereby moving the third element into a horizontal position, that a surface of the first element 52 is forced against a support member 66 positioned along a sidewall of the cavity 24.

FIGS. 3 through 5 show the interaction between the contact 50 and the cavity 24 as the contact 50 enters the upper portion 16 of flange 14. In FIG. 3 the contact is shown prior to being inserted into the cavity 24. In FIG. 4 the contact 50 is shown partially inserted into the cavity 24 to the point where the nose portion 58 is abutted against the end wall 60. However, the contact 50 has not been inserted to the point where the third element 56 of the contact begins to assume a horizontal position.

In FIG. 5 the contact 50 is shown fully inserted into the cavity 24 so that the third element 56 is in a horizontal position and resting flush against the end wall 60 of the cavity 24. As discussed above, the pushing of the third element 56 of the contact against the end wall 60 is accomplished by continuing to insert the contact into the cavity after the nose portion 58 has engaged the end wall.

In the position of FIG. 5 it can be seen that the first element 52 has been moved in a direction substantially transverse to the direction of insertion force. The distances $d_1$ and $d_2$ are such that when the third element 56 is in a horizontal position, the first element 52 is pressed against the coil wire 2. The coil wire 2 is in turn pressed against support member 66.

Figure 6:
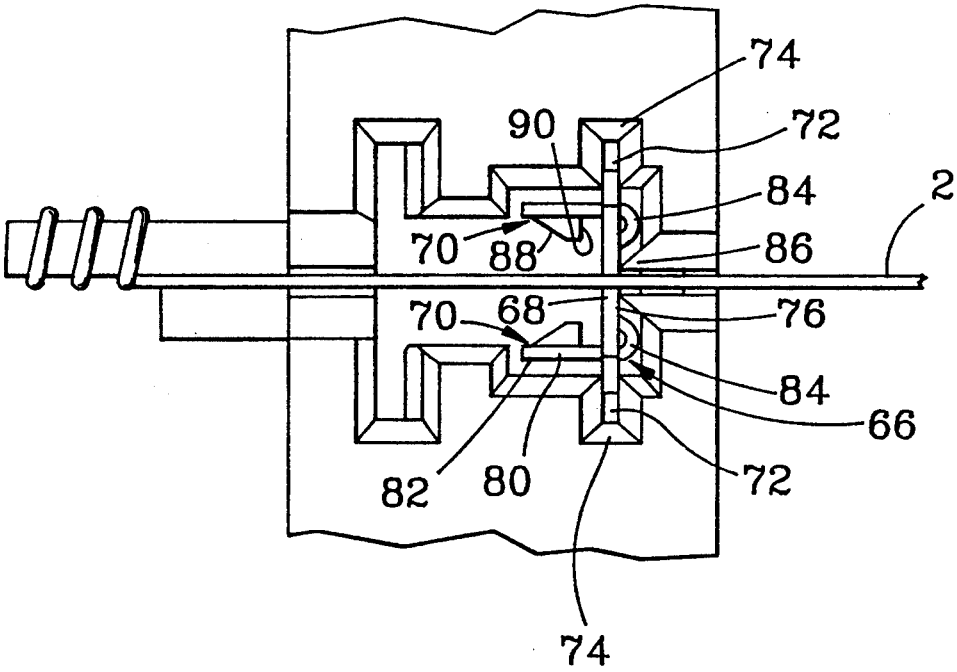
FIG. 6 is a top view of the reinforced cavity shown in FIG. 3.

Support member 66, as best shown in FIGS. 3 and 6, has a wall 68 from which project two contact securing members 70. The wall is constructed from metal or other material having similar characteristics to the contact. The support member 66 is positioned and secured in cavity 24. Portions 72 of wall 68 extend into securing recesses 74 of cavity 24 and provide a frictional engagement therebetween. The frictional engagement is sufficient to ensure that the support member 66 will remain in position relative to the cavity 24.

As is shown in FIG. 3, the wall 68 is dimensioned to be approximately the same height as a respective sidewall of the cavity. A slot 76 is provided in the wall 68 for receipt of the coil wire 2 therein. The slot 76 has similar dimensions to slot 28 and is positioned adjacent to slot 28 so that the coil wire may pass through both slot 76 and slot 28.

Contact securing members 70 have securing projects 78 provided at free end portions of resilient arms 80. The resilient arms 80 are stamped from the wall 68 and are formed, as best shown in FIG. 6. The end portions 82 of the arms 80 extend in a direction which is essential perpendicular to the plane of wall 68. The resilient arms 80 are bent such that proximate the fixed end thereof an arcuate member 84 is formed. This arcuate member 84 extends beyond the plane of the wall 68 is the opposite direction of the free end portions 82. As shown in FIG. 6, the arcuate members 84 cooperate with a projection 86 of the side wall of the cavity. The cooperation of the arcuate member 84 and the projection 86 provides the alignment means required to position the slots 76 and slots 28 in proper position.

Securing projections 78 have lead-in surfaces 88 and locking shoulder 90. The locking shoulders 90 are essentially parallel to the wall 68, as shown in FIG. 6.

As was previously described, the first element 52 is moved in a direction which is substantially transverse to the direction of the insertion force. This forces the first element against the coil wire 2. As the movement of the first element occurs, the first element engages the securing projections 78. As the movement continues, the first element will ride across the lead-in surface, causing the resilient arms 80 to be moved toward respective sidewalls. As the first element 52 approaches the position shown in FIG. 5, the element 52 moves beyond securing projections 78, thereby allowing the resilient arms 80 to return to an unstressed position. In this position, the locking shoulders 90 cooperate with the first element 52 to prevent the first elements from moving away from wall 68. This ensures that a positive electrical connection is effected and maintained between the first element 52 and the coil wire 2.

In the fully inserted position, the coil wire 2 is trapped between the first element 52 and the wall 68 of support member 66. It is important that the support member 66 and the contact 50 be made from material which have similar coefficients of expansion. The bobbins which house the contacts are exposed to temperature changes in relatively harsh environments. Consequently, if the first element 52 and wall 68 have substantially different characteristics, the wire will not be maintained against the first element, resulting in an ineffective electrical connection. However, as the support member and contact have similar characteristics, a positive electrical connection will be obtained in all environments.

Another advantage of stamping and forming the support member relates to the manufacture of the cavity. In the prior art, the coil wire was trapped between the contact and the side wall of the cavity. In order for this to be an effective electrical connection, the dimensions of the cavity must be precisely controlled. If the tolerances of the cavity are not controlled, the coil wire will not be forced into engagement with the contact. Consequently, in order to ensure that a positive electrical connection is effected, expensive molding processes must be used to control the tolerances. The use of a support member eliminates the need for the expensive molding process, as the need to precisely control the dimensions of the cavity is reduced significantly.

Changes in construction will occur to those skilled in the art and various apparently different modifications and embodiments may be made without departing from the scope of the invention. The matter set forth in the foregoing description and accompanying drawings is offered by way of illustrations only.

I claim:

1. An electrical connector assembly having a plurality of contact receiving cavities provided therein, a plurality of contacts are positioned in the contact receiving cavities, the contacts electrically engage wires which are positioned in the contact receiving cavities, the electrical connector comprising:

separate support members positioned in the cavities adjacent the contacts, the support members have wall portions which extend along respective side walls of the contact receiving cavities, the support members are made from a metal material having an appropriate stiffness, the support members have resilient arms, the resilient arms have free end portions which extend in a direction which is essentially perpendicular to the plane of the wall portions of the support members, the free end portions of the resilient arms have securing projections provided thereon, the securing projections have lead-in surfaces and locking shoulders, whereby as contact portions of the contacts are moved toward the support members, the locking shoulders of the securing projections will cooperate with the contact portions to maintain the contact portions in a position in which the wires are provided in electrical engagement with the contact portions, and the support members cooperate with the wires positioned in the contact receiving cavities to ensure that the wires will be maintained in electrical engagement with the contacts.

2. An electrical connector assembly as recited in claim 1 wherein the respective side walls of the contact receiving cavities have first slots provided therein for receipt of the wires, the support members have second slots provided therein for receipt of the wires, the first slots and the second slots have similar dimensions.

3. An electrical connector assembly as recited in claim 1 wherein the support members have securing portions which extend therefrom, the contact receiving cavities have securing recesses provided proximate thereto, the securing portions cooperate with the securing recesses to provide frictional engagement therebetween which maintains the support members in position relative to the contact receiving cavities.

4. An electrical connector assembly as recited in claim 1 wherein the resilient arms have arcuate members provided proximate the fixed ends thereof, the arcuate members extend beyond the plane of the wall portions of the support members in the opposite direction from the free end portions, the arcuate members cooperate with projections of the side walls of the contact receiving cavities to provide the alignment means required to ensure that the support members will be properly aligned in the contact receiving cavities.

5. An electrical connector assembly as recited in claim 1 wherein the wires are coil wires which enter the contact receiving cavities through slots provided in the side walls of the cavities and the support members, the support members are positioned and secured in the contact receiving cavities such that when the contacts are fully inserted into the contact receiving cavities, the coil wires are trapped between the support members and the contacts to provide a reliable electrical connection between the coil wires and the contacts.

6. An electrical connector assembly, comprising:

an insulative housing having a plurality of contact receiving cavities therein for receiving terminals;

generally planar support members positioned in the cavities having wall portions which extend along respective side walls of the contact receiving cavities, the support members are made from a metal material having an appropriate stiffness;

terminals intertable into said cavities, being adapted to trap wires positioned said cavities, between a contact surface of said terminal and said support member wall portion;

the side walls of said contact receiving cavities and said support members having similarly dimensioned slots to receive therein a wire to be terminated.

7. An electrical connector assembly as recited in claim 6, wherein the support members have securing portions which extend therefrom, the contact receiving cavities have securing recesses provided proximate thereto, the securing portions cooperate with the securing recesses to provide frictional engagement therebetween which maintains the support members in position relative to the contact receiving cavities.

8. An electrical connector assembly as recited in claim 6, wherein the support members have resilient arms, the resilient arms have free end portions which extend in a direction which is essentially perpendicular to the plane of the wall portions of the support members.

9. An electrical connector assembly as recited in claim 8, wherein the free end portions of the resilient arms have securing projections provided thereon, the securing projections have lead-in surfaces and locking shoulders, whereby as contact portions of the contacts are moved toward the support members, the locking shoulders of the securing projections will cooperate with the contact portions to maintain the contact portions in a position in which the wires are provided in electrical engagement with the contact portions.

10. An electrical connector assembly as recited in claim 8, wherein the resilient arms have arcuate members provided proximate to fixed ends thereof, the arcuate members extend beyond the plane of the wall portions of the support members in the opposite direction from the free end portions, the arcuate members cooperate with projections of the side walls of the contact receiving cavities to provide the alignment means required to ensure that the support members will be properly aligned in the contact receiving cavities.

11. An electrical connector assembly as recited in claim 6, wherein the wires are coil wires which enter the contact receiving cavities through slots provided in the side walls of the cavities and the support members, the support members are positioned and secured in the contact receiving cavities such that when the contacts are fully inserted into the contact receiving cavities, the coil wires are trapped between the support members and the contacts to provide a reliable electrical connection between the coil wires and the contacts.

12. An electrical connector comprising an insulative housing having a receiving cavity, an electrical terminal insertable into said receiving cavity, and adapted for engagement with a wire to be inserted in the cavity by trapping the wire between a contact surface of the terminal with a support surface in said housing, the connector being characterized in that a discrete supporting member is prepositioned in said cavity, such that said supporting surface is defined on said supporting member, for trapping said wire between said supporting member and said terminal contact surface, said support member including contact securing members to retain the contact surface in engagement with the wire.

13. The electrical connector of claim 12, characterized in that said support member is formed by a planar wall portion which is adapted for positioning against a major surface defining said receiving cavity.

14. The electrical connector of claim 12, characterized in that the electrical terminal is defined by first and second walls with a medial nose portion, and said terminal is adapted for deformation, upon insertion into said cavity whereby said nose portion conforms to a lower surface of said cavity, and said first and second walls are positioned against respective cavity walls.

15. The electrical connector of claim 14, characterized in that the first and second terminal wall portions, and the deformable nose portion, are profiled by rolled surfaces, whereby when in the fully inserted position, the first and second wall portions, and the deformable nose portion, form substantially planar surfaces, lying against respective major surfaces in said cavity.

16. The electrical connector of claim 12, characterized in that said contact securing members are defined by latches which retain said contact in a fully inserted position.

17. The electrical connector of claim 12, characterized in that said contact securing members are defined by latch arms on side wall extensions of said supporting members, whereby when said nose portion is moved into said deformed position, side edges of said nose portion move behind said latch arms, firmly securing said wire in a trapped engagement against said contact surface.

18. The electrical connector of claim 12, characterized in that said support member is comprised of a conductive metal.

* * * * *